US006654581B2

(12) United States Patent
Liu et al.

(10) Patent No.: US 6,654,581 B2
(45) Date of Patent: Nov. 25, 2003

(54) FOOLPROOF DEVICE USED IN A PROCESS CARTRIDGE FOR AN IMAGE FORMING APPARATUS

(75) Inventors: Ren-Hao Liu, Taichung (TW); Shu Hui Wang, Taichung (TW); Xiao Hui Wang, Taichung (TW); Ting Hsuan Ko, Taichung (TW); Jui-Chi Wang, Taichung (TW); Robin Hsu, Taichung (TW); Ya Li Huang, Taichung (TW); Kuan Tung Li, Yunlin (TW); Hui Wen Hsieh, Taichung (TW)

(73) Assignee: General Plastics Co., Ltd. (TW)

( * ) Notice: Subject to any disclaimer, the term of this patent is extended or adjusted under 35 U.S.C. 154(b) by 0 days.

(21) Appl. No.: 10/171,036

(22) Filed: Jun. 11, 2002

(65) Prior Publication Data

US 2003/0198489 A1 Oct. 23, 2003

(30) Foreign Application Priority Data

Feb. 8, 2002 (TW) ..... 91201949 U

(51) Int. Cl.[7] ..... G03G 15/08; G03G 21/18

(52) U.S. Cl. ..... 399/262; 399/113; 399/258

(58) Field of Search ..... 399/111, 113, 399/105, 256, 258, 259, 260, 262, 106, 109; 222/DIG. 1; 141/364

(56) References Cited

U.S. PATENT DOCUMENTS

| | | | | | |
|---|---|---|---|---|---|
| 5,229,824 | A | * | 7/1993 | Tsusaka et al. | 399/262 |
| 5,268,722 | A | * | 12/1993 | Ikkatai et al. | 399/262 |
| 5,412,364 | A | * | 5/1995 | Iguchi et al. | 399/106 |
| 5,513,679 | A | * | 5/1996 | Yamada | 222/DIG. 1 |
| 6,029,031 | A | * | 2/2000 | Yokomori et al. | 399/109 |
| 6,169,865 | B1 | * | 1/2001 | Miyabe et al. | 399/111 |

FOREIGN PATENT DOCUMENTS

JP 07271165 A * 10/1995 ..... G03G/15/08

* cited by examiner

*Primary Examiner*—Sophia S. Chen
*Assistant Examiner*—Ryan Gleitz
(74) *Attorney, Agent, or Firm*—Merchant & Gould LLC

(57) ABSTRACT

A foolproof device used in a process cartridge for an image forming apparatus, where the process cartridge has a developing device and a toner container, includes female engagement portions of two different sizes formed in the toner container, projections formed in the toner container, and male engagement portions of two different sizes formed in the developing device and adapted for guiding correct installation of the toner container in the developing device and securing the toner container to the developing device.

3 Claims, 4 Drawing Sheets

FOOLPROOF DEVICE USED IN A PROCESS CARTRIDGE FOR AN IMAGE FORMING APPARATUS

BACKGROUND OF THE INVENTION

1. Field of the Invention

The present invention relates to a process cartridge for image forming apparatus and, more specifically, to a foolproof device used in an image forming apparatus, which prevents an installation error of the toner container in the developing device.

2. Description of the Related Art

A regular process cartridge for a laser printer is generally comprised of an electrophotographic photosensitive member, developing means, charging means, cleaning means, and a toner container. When the toner of the toner container used up, the whole assembly of the process cartridge becomes useless and must be thrown away. It is not economic to throw the whole assembly of the process cartridge away after empty of the process cartridge. Further, the waste process cartridge may cause pollution to the environment if it is not well disposed of.

SUMMARY OF THE INVENTION

The present invention has been accomplished to eliminate the aforesaid drawbacks. In one aspect, the present invention relates to a process cartridge, which enables the user to replace the toner container without throwing the other parts of the process cartridge away when the toner is used up. In another aspect, the present invention relates to a foolproof device that can be used in a process cartridge having a developing device and a toner container, which prevents leakage of toner due to an installation error of the toner container in the developing device. In one embodiment of the present invention, the foolproof device comprises a plurality of male engagement portions formed on the developing device of the process cartridge, a plurality of female engagement portions formed on the toner container, and a plurality of projections also formed on the toner container of the process cartridge. The male engagement portions are different in size. The female engagement portions are also different in size and fit the male engagement portions respectively. The foolproof device guides correct installation of the toner container in the developing device, preventing leakage of toner due to a wrong installation of the toner container in the developing device.

DETAILED DESCRIPTION OF THE PREFERRED EMBODIMENT

Figure 1:
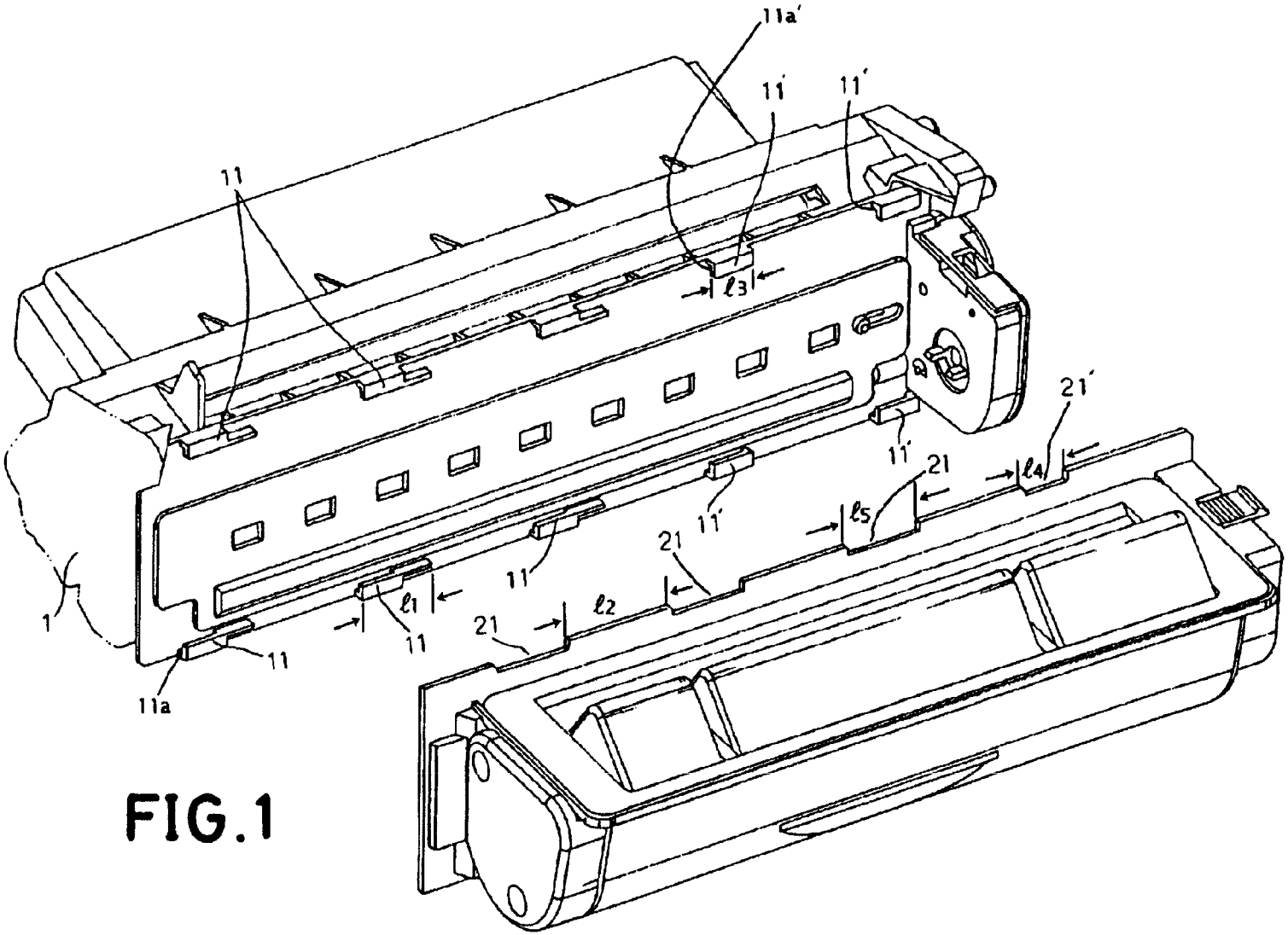
FIG. 1 is an exploded view of the preferred embodiment of the present invention.

Referring to FIG. 1, a process cartridge constructed in accordance with the present invention is shown comprised of a developing device 1 and a toner container 2.

The developing device 1 comprises electrophotographic photosensitive means, developing means, process device matching the developing means (these attached means are not within the scope of the claims of the present invention, no further detailed description is necessary).

Figure 2:
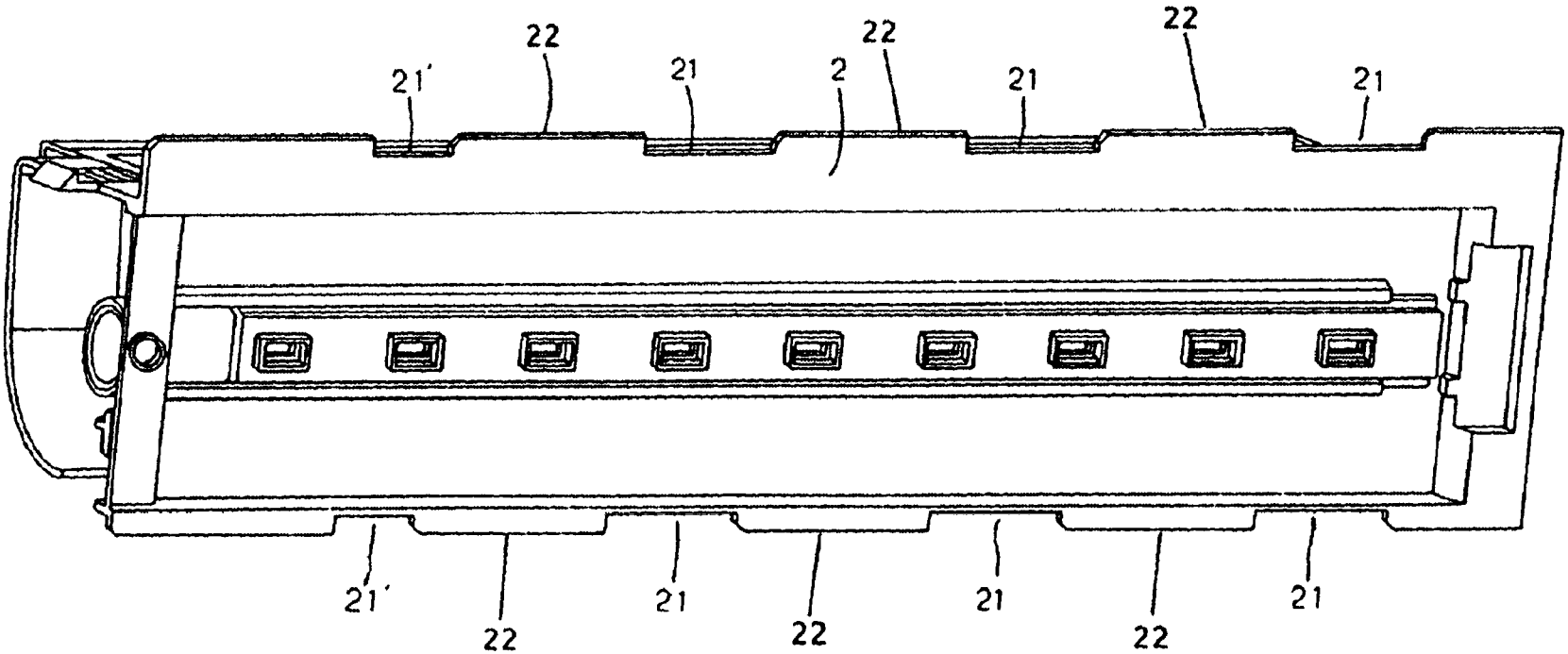
FIG. 2 is a front elevational view of the toner container according to the present invention.

Referring to FIG. 2, the toner container 2 comprises toner stirring means and toner supplying openings (since the toner stirring means and toner supplying openings are not within the scope of the claims of the present invention, no further detailed description is necessary). The toner container 2 further comprises a plurality of first female engagement portions 21 characterized by a length $l_5$, a plurality of second female engagement portions 21' characterized by a length $l_4$ for preventing misengagement of the toner container 2 from the developing device 1, and a plurality of projections 22, wherein each pair of neighboring projections 22 defines either a first female engagement portion 21 or a second female engagement portion 21'. The first female engagement portions 21 and the second female engagement portions 21' have different longitudinal lengths, $l_5$ and $l_4$ respectively.

Referring to FIG. 1 again, the developing device 1 comprises a plurality of first male engagement portions 11 having a groove 11*a* and a length $l_1$ and a plurality of second male engagement portions 11' having a groove 11*a'* and a length $l_3$, respectively, disposed corresponding to the first female engagement portions 21 and the second female engagement portions 21' of the toner container 2. The first male engagement portions 11 and the second male engagement portions 11' have different lengths, $l_1$ and $l_3$, respectively, and are adapted for engaging the first female engagement portions 21 and the second female engagement portions 21' of the toner container 2 respectively.

Figure 3:
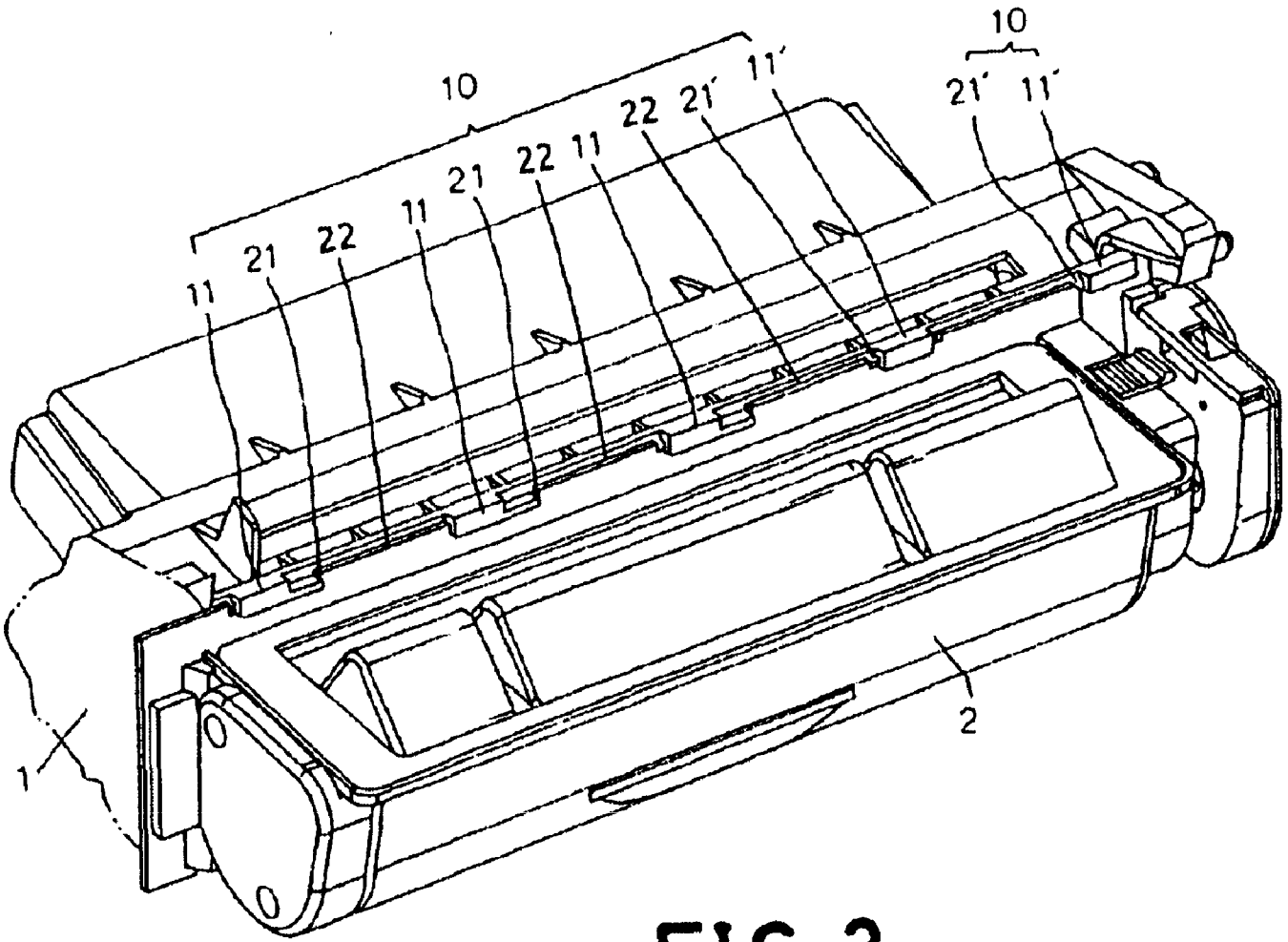
FIG. 3 illustrates the female engagement portions of the toner container respectively positioned with respect to the male engagement portions of the developing device and set in the initial engagement position.
Figure 4:
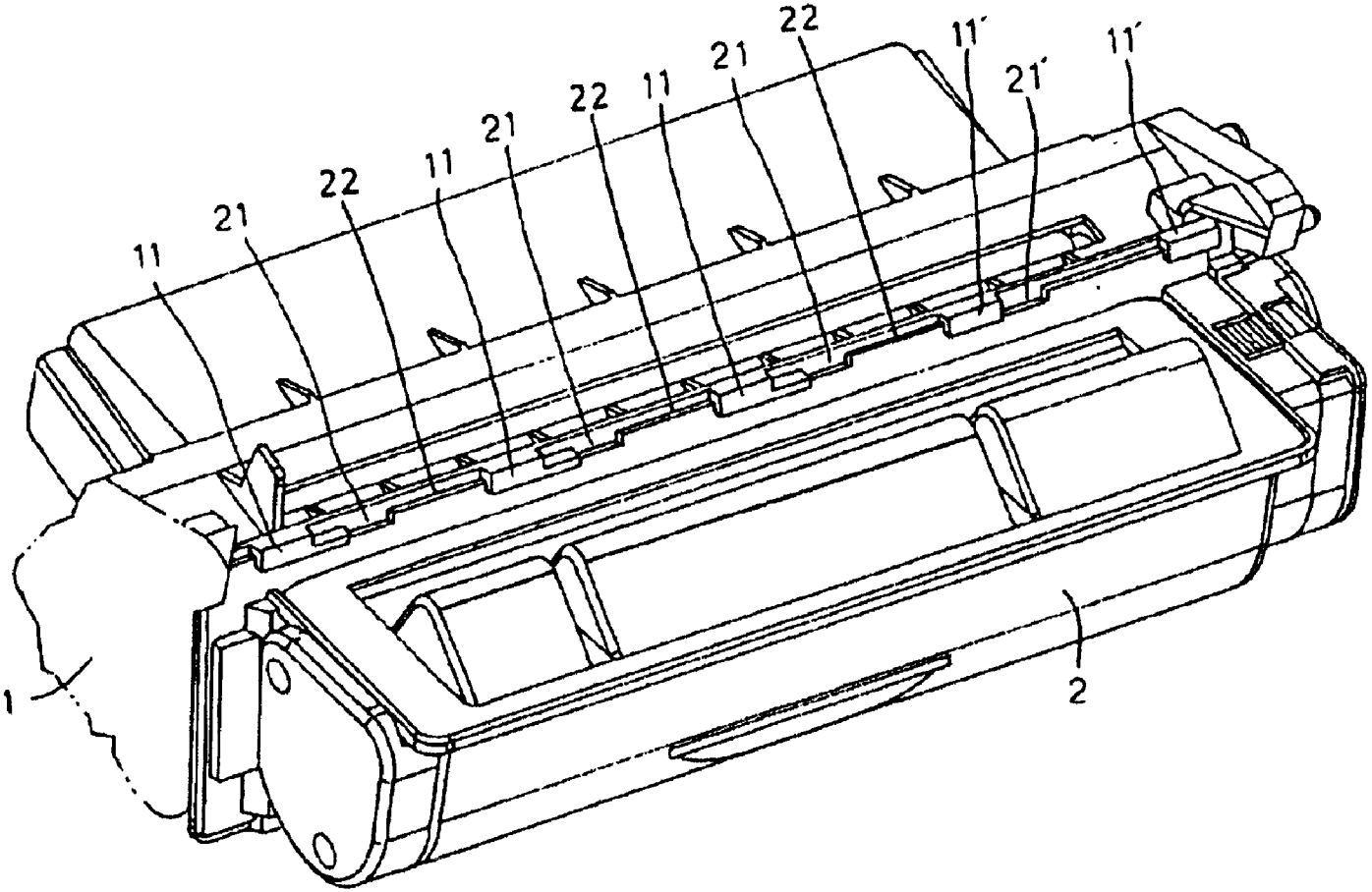
FIG. 4 illustrates the toner container installed in the developing device according to the present invention.

Referring to FIGS. 3 and 4 and FIG. 1 again, during installation, the toner container 2 is attached to the developing device 1, keeping the first female engagement portions 21 and the second female engagement portions 21' of the toner container 2 respectively positioned with respect to the first male engagement portions 11 and the second male engagement portions 11' of the developing device 1, i.e., the initial engagement position 10 as shown in FIG. 3, and then the developing device 1 and the toner device 2 are moved relative to each other subject to the design direction to force the first male engagement portions 11 and second male engagement portions 11' of the developing device into engagement with the projections 22 of the toner container 2. Specifically, when the toner container 2 is shifted to be mounted on the developing device 1 at a predetermined position, each projection 22 of the toner container 1 is received in either groove 11*a* of a corresponding first male engagement portion 11 or in groove 11*a'* of a corresponding second male engagement portion 11', as illustrated in FIG. 4. Because the first male engagement portions 11 and the second male engagement portions 11' have different sizes and the first female engagement portions 21 and the second female engagement portions 21' fit the first male engagement portions 11 and the second male engagement portions 11' respectively, the toner container 2 cannot be closely attached to the developing device and secured thereto in the correct position if the first female engagement portions 21 and the second female engagement portions 21' are not positioned at the first male engagement portions 11 and the second male engagement portions 11' respectively. The first male engagement portions 11 and the second male engagement portions 11' of the developing device 1, the first female engagement portions 21 and the second female engagement portions 21' of the toner container 2, and the projections 22 of the toner container 2 form a foolproof device, which prevents leakage of toner due to an installation error of the toner container 2 in the developing device 1.

A prototype of foolproof device has been constructed with the features of FIGS. 1~4. The foolproof device functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A foolproof device used in a process cartridge for an image forming apparatus, wherein the process cartridge has a developing device adapted for receiving toner and forming images with received toner and a toner container adapted for supplying toner to said developing device for forming images, comprising:

a plurality of first engagement portions provided on the developing device, each first engagement portion having a groove and a length;

a second engagement portion provided on the developing device, the second engagement portion having a groove and a length that is different from the length of at least one first engagement portion of the developing device, wherein the second engagement portion provided on the developing device is substantially aligned with the plurality of first engagement portions provided on the developing device along an axis of the developing device;

a plurality of first engagement portions provided on the toner container, wherein each of the first engagement portions of said toner container has a length and is adapted for engaging each of the first engagement portions of said developing device; and a plurality of projections provided on the toner container complimentary to the plurality of first engagement portions of the developing device, wherein when the toner container is shifted to be mounted on the developing device at a predetermined position, each of the projections is received in the groove of a corresponding first engagement portion of the developing device so as to be engaged by the first engagement portion.

2. The foolproof device according to claim 1, further comprising:

a second engagement portion provided on the toner container complimentarily to the second engagement portion of the developing device, wherein the second engagement portion provided on the toner container is characterized by a length that is different from the length of the first engagement portion of the toner container, wherein the second engagement portion provided on the toner container is substantially aligned with the plurality of the first engagement portions provided on the toner container along an axis of the toner container, and wherein said second engagement portion of said toner container is adapted for engaging the second engagement portion of the developing device.

3. A foolproof device used in a process cartridge for an image forming apparatus, wherein the process cartridge has a developing device adapted for receiving toner and forming images with received toner and a toner container adapted for supplying toner to said developing device for forming images, comprising:

a plurality of first engagement portions provided on the developing device, each first engagement portion having a groove and a length;

a plurality of first engagement portions provided on the toner container, wherein each of the first engagement portions of said toner container has a length and is adapted for engaging each of the first engagement portions of said developing device;

a plurality of projections provided on the toner container complimentary to the plurality of first engagement portions of the developing device, wherein when the toner container is shifted to be mounted on the developing device at a predetermined position, each of the projections is received in the groove of a corresponding first engagement portion of the developing device so as to be engaged by the first engagement portion;

a second engagement portion provided on the developing device for preventing misengagement of the toner container, the second engagement portion having a groove and a length that is different from the length of each first engagement portion, wherein the second engagement portion provided on the developing device is substantially aligned with the plurality of the first engagement portions provided on the developing device along an axis of the developing device; and a second engagement portion provided on the toner container complimentarily to the second engagement portion of the developing device, wherein the second engagement portion of the toner container is characterized by a length that is different from the length of the first engagement portion of the toner container, wherein the second engagement portion provided on the toner container is substantially aligned with the plurality of the first engagement portions provided on the toner container along an axis of the toner container, of said toner container is adapted for engaging the second engagement portion of the developing device.

* * * * *